US005349570A

United States Patent [19]

Kaiser

[11] Patent Number: 5,349,570

[45] Date of Patent: Sep. 20, 1994

[54] METHOD FOR OPERATION OF A RADIO-CONTROLLED CLOCK AND RADIO-CONTROLLED CLOCK FOR USE IN AN ENVIRONMENT SUBJECT TO INTERFERENCE FIELDS

[75] Inventor: Reinhold Kaiser, Heilbronn, Fed. Rep. of Germany

[73] Assignee: Temic Telefunken microelectronic GmbH, Heilbronn, Fed. Rep. of Germany

[21] Appl. No.: 102,244

[22] Filed: Aug. 5, 1993

[30] Foreign Application Priority Data

Oct. 2, 1992 [DE] Fed. Rep. of Germany ..... 4233126

[51] Int. Cl.[5] ..... G04C 11/02

[52] U.S. Cl. ..... 368/47

[58] Field of Search ..... 366/10, 11, 47; 455/63, 455/66, 296, 244

[56] References Cited

U.S. PATENT DOCUMENTS

| | | | |
|---|---|---|---|
| 3,590,573 | 7/1971 | Dietsch . | |
| 4,419,017 | 12/1983 | Okuyama et al. | 368/64 |
| 4,650,344 | 3/1987 | Allgaier et al. | 368/47 |
| 4,823,328 | 4/1989 | Conklin et al. | 368/47 |
| 5,083,123 | 1/1992 | Ganter et al. | 368/47 |
| 5,235,563 | 8/1993 | Ganter et al. | 368/47 |

FOREIGN PATENT DOCUMENTS

| | | |
|---|---|---|
| 0258838 | 8/1987 | Fed. Rep. of Germany . |
| 54-133166 | 10/1979 | Japan . |
| 03141728 | 6/1991 | Japan . |

*Primary Examiner*—Vit W. Miska

*Attorney, Agent, or Firm*—Spencer, Frank & Schneider

[57] ABSTRACT

A method for operation of a radio-controlled clock comprising a quartz-controlled clock synchronized by a time signal receiver with a time signal via a signal processor. In a common array with an additional device, such as a computer or television set, reception of the time signal is generally largely prevented by the interference effect of the additional device. In the method in accordance with the invention, the quartz-controlled clock is therefore synchronized with the time signal solely when the additional device is no longer generating an interference field. For this purpose, a detector is provided that recognizes the operating state of the additional device and permits synchronization of the quartz-controlled clock with the time signal only when the additional device is not generating an interference field, or if so only a reduced one. Furthermore, a radio-controlled clock is described that is suitable for operation by the method in accordance with the invention.

9 Claims, 1 Drawing Sheet

METHOD FOR OPERATION OF A RADIO-CONTROLLED CLOCK AND RADIO-CONTROLLED CLOCK FOR USE IN AN ENVIRONMENT SUBJECT TO INTERFERENCE FIELDS

BACKGROUND OF THE INVENTION

The invention relates to a method for operation of a radio-controlled clock, comprising a quartz-controlled clock and a time signal receiver which receives a time signal for synchronizing the quartz-controlled clock, in which the radio-controlled clock is connected in a common array with an additional device which can have several operating states and which generates a strong interference field in a first operating state and a reduced or non-existent field in a second operating state.

Radio-controlled clocks are generally supplied with a time signal for instance by the transmitter DCF-77 of Germany's Physikalisch-technische Bundesanstalt. A first type of radio-controlled clock receives the time signal continuously and always displays the received time. A second type of radio-controlled clock synchronizes an autonomously operating, quartz-controlled clock periodically with the time signal. Small, battery-operated radio-controlled clocks in particular work according to the second principle for energy-saving reasons. Synchronization of the internal clock mechanism with the time signal takes place typically in the early hours of the morning and every 24 hours, and is independent of other factors such as the reception quality of the time signal or the strength of the interference fields prevailing in the environment.

It is furthermore known that many electronic units in the field of signal generation or signal processing generate interference fields that disturb or render impossible other functions in the same unit or the functions of equipment standing in close vicinity. This type of interference field prohibits the operation of radio-controlled clocks in equipment such as personal computers (PCs), television sets, video recorders etc. When operating equipment of this type, reception of the time signal is only possible after very high technical expenditure.

SUMMARY OF THE INVENTION

A first object of the invention is to provide a method for operation of a radio-controlled clock that permits operation of the radio-controlled clock in an environment subject to interference fields. This object is attained by a method for operation of a radio-controlled clock, comprising a quartz-controlled clock and a time signal receiver which receives a time signal for synchronizing the quartz-controlled clock, in which the radio-controlled clock is connected in a common array with an additional device which can have several operating states and which generates a strong interference field in a first operating state and a reduced or non-existent interference field in a second operating state, and wherein the method comprises synchronizing the quartz-controlled clock with the time signal solely when the additional device is in the second operating state.

A further object of the invention is to provide a radio-controlled clock suitable for operation in an environment subject to interference fields. This object is attained by a common array for controlling a radio-controlled clock, comprising: a radio-controlled clock having a quartz-controlled clock connected to a time signal receiver which receives a time signal for synchronizing the quartz-controlled clock; an additional device, connected to the radio-controlled clock, having first and second operating states and generating a strong interference field during the first operating state and a reduced or non-existent interference field during the second operating state; and a detector, connected to the radio-controlled clock and the additional device, for determining the operating state of the additional device, and for allowing synchronization of the quartz-controlled clock by the time signal only when the additional device is in the second operating state.

An embodiment of the invention is described in detail in the following on the basis of figures.

DESCRIPTION OF THE PREFERRED EMBODIMENTS

Figure 1:
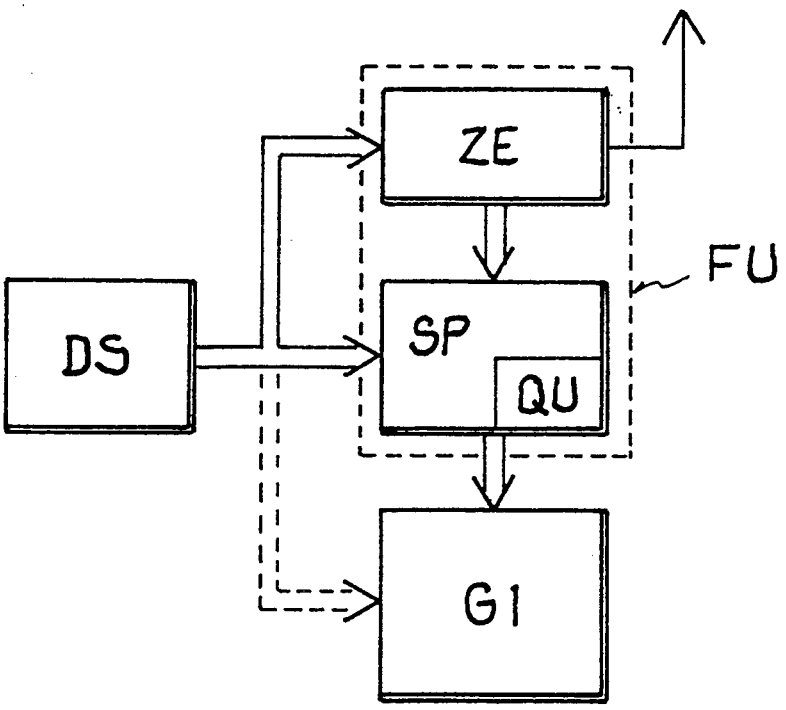
FIG. 1 shows a block diagram of a first embodiment of the radio-controlled clock in accordance with the invention.
Figure 2:
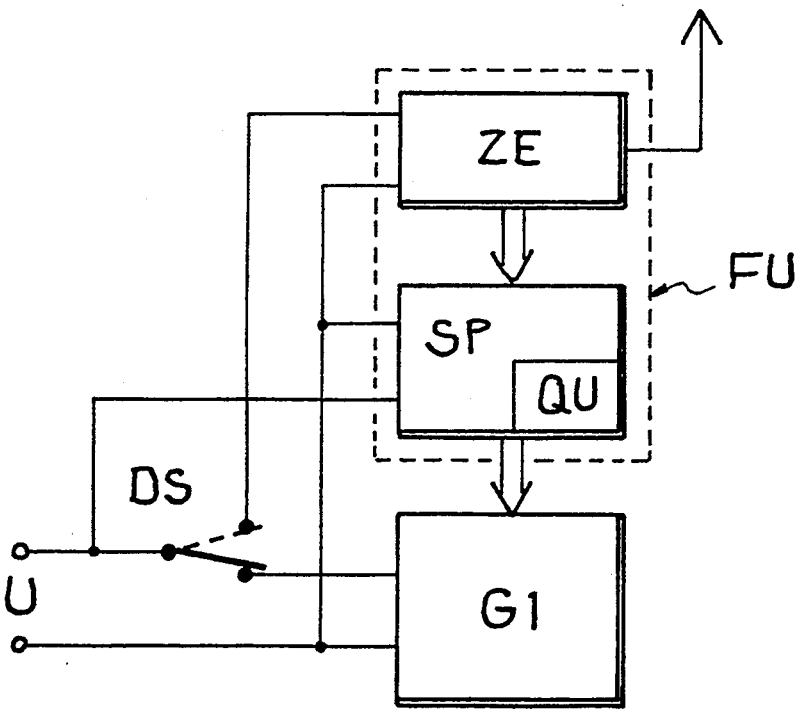
FIG. 2 shows a second embodiment of the invention.

The array shown in FIG. 1 comprises a radio-controlled clock FU with a quartz-controlled clock QU that is synchronized with the received time signal by a time signal receiver ZE via a signal processor SP. The time signal receiver ZE has an antenna suitable for reception of the time signal. The radio-controlled clock FU forms together with an additional device G1 a function unit, where the additional device G1 can have operating states generating an interference field that disturbs or renders impossible the reception of the time signal. A detector DS is provided in accordance with the invention that recognizes this type of operating state in the additional device G1 and, when such an operating state is present, prevents the synchronization of the quartz-controlled clock QU with the time signal.

In an advantageous embodiment of the invention, the detector DS is connected to the time signal receiver ZE and suppresses the reception of the time signal when the additional device G1 is generating strong interference fields. The additional device G1 can be, for example, a computer, a calculator, a PC, a mainframe, a motor vehicle or a television set. All of these have in common the fact that they generate an interference signal during operation that does not permit simultaneous radio controlled operation of the radio-controlled clock. On the other hand, none of them generate an interference signal in the switched-off state.

In a further embodiment of the invention, the detector DS monitors the supply of the operating voltage UB to the additional device G1. Synchronization takes place exclusively when no operating voltage is being supplied to the additional device which is hence in the switched-off state. The detector comprises in this case a changeover switch that supplies the operating voltage to the time signal receiver ZE alternately to the additional device G1. This measure ensures that the time signal receiver ZE can only be put into operation when no operating voltage is being supplied to the additional device G1 and when the additional device G1 is switched off.

In a further advantageous embodiment of the invention, the detector comprises a wide-band radio receiver that picks up the interference radiation generated by the additional device G1 and, above a certain strength of said interference radiation, prevents synchronization of the quartz-controlled clock QU by the time signal receiver ZE.

In both the above versions of the invention, it can be provided that the next synchronization of the quartz-controlled clock QU takes place after a fixed period since the last synchronization. This enables synchronization to take place every 24 hours, for example. In periodic operation of the additional device G1, synchronization of the quartz-controlled clock QU with the time signal also takes place regularly.

What is claimed is:

1. A method for operation of a radio-controlled clock comprising a quartz-controlled clock and a time signal receiver which receives a time signal for synchronizing said quartz-controlled clock, said radio-controlled clock connected in a common array with an additional device which can have several operating states and which generates a strong interference field in a first operating state and a reduced or non-existent interference field in a second operating state; and wherein said method comprises synchronizing said quartz-controlled clock with said time signal solely when said additional device is in said second operating state.

2. A method according to claim 1, further comprising the step of recognizing the operating state of said additional device using a detector.

3. A method according to claim 2, further comprising controlling said step of synchronizing said quartz-controlled clock with said time signal by said detector.

4. A method according to claim 3, wherein said step of controlling includes causing no further synchronization to take place during a predetermined time interval following the last synchronization.

5. A method according to claim 4, wherein during said step of synchronizing, synchronization takes place following said predetermined time interval, and when said detector has recognized said second operating state of said additional device.

6. A method according to claim 1, wherein during said step of synchronizing, said time signal is continuously received and evaluated during said second operating state of said additional device.

7. A common array for controlling a radio-controlled clock, comprising:

a radio-controlled clock having a quartz-controlled clock connected to a time signal receiver which receives a time signal for synchronizing said quartz-controlled clock;

an additional device, connected to said radio-controlled clock, having first and second operating states, and generating a strong interference field during said first operating state and a reduced or non-existent interference field during said second operating state; and a detector, connected to said radio-controlled clock and said additional device, for determining the operating state of said additional device, and for allowing synchronization of said quartz-controlled clock by said time signal only when said additional device is in said second operating state.

8. A common array according to claim 7, wherein said detector monitors an operating voltage of said additional device.

9. A common array according to claim 8, wherein said detector allows the synchronization of said clock by said time signal when said operating voltage is not applied to said additional device.

* * * * *